US010961969B2

(12) United States Patent
Hashizume et al.

(10) Patent No.: US 10,961,969 B2
(45) Date of Patent: Mar. 30, 2021

(54) STARTUP ASSISTANCE DEVICE FOR INTERNAL COMBUSTION ENGINE

(71) Applicant: HONDA MOTOR CO., LTD., Tokyo (JP)

(72) Inventors: Takashi Hashizume, Saitama (JP); Akifumi Fujima, Saitama (JP); Keiichiro Bungo, Saitama (JP); Hisanori Kanayama, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/642,602

(22) PCT Filed: Sep. 1, 2017

(86) PCT No.: PCT/JP2017/031664
§ 371 (c)(1),
(2) Date: Feb. 27, 2020

(87) PCT Pub. No.: WO2019/043925
PCT Pub. Date: Mar. 7, 2019

(65) Prior Publication Data

US 2020/0347812 A1 Nov. 5, 2020

(51) Int. Cl.
*F02N 5/02* (2006.01)
*F02D 41/30* (2006.01)
(Continued)

(52) U.S. Cl.
CPC ..... *F02N 5/02* (2013.01); *F02D 41/3005* (2013.01); *F02N 11/0862* (2013.01);
(Continued)

(58) Field of Classification Search
CPC .... F02N 5/02; F02N 11/0862; F02N 2200/02; F02N 2200/06; F02D 41/3005
(Continued)

(56) References Cited

U.S. PATENT DOCUMENTS

2013/0340698 A1* 12/2013 Provost ..... F02N 3/02 123/179.5
2015/0107542 A1 4/2015 Kyokane et al.
(Continued)

FOREIGN PATENT DOCUMENTS

JP H07-103111 A 4/1995
JP 2014-066198 A 4/2014
JP 2015-081540 A 4/2015

OTHER PUBLICATIONS

Oct. 10, 2017, International Search Report issued for related PCT Application No. PCT/JP2017/031664.
(Continued)

*Primary Examiner* — Mahmoud Gimie
(74) *Attorney, Agent, or Firm* — Paratus Law Group, PLLC

(57) ABSTRACT

A startup assistance device, which assists startup of an internal combustion engine in which fuel is supplied from an electronically controlled fuel injection device and ignition is performed by an ignition device, includes a recoil starter which is driven by manpower and which performs cranking for starting up the internal combustion engine, an electric rotary machine which adds torque to a crankshaft of the internal combustion engine during at least one of a startup period of the internal combustion engine using the recoil starter and a standby period before the startup period, a power source unit which supplies power to the electric rotary machine, and a control unit which controls the magnitude and time of the torque output by the electric rotary machine.

11 Claims, 5 Drawing Sheets

(51) Int. Cl.
*F02N 11/08* (2006.01)
*F02N 19/00* (2010.01)

(52) U.S. Cl.
CPC ..... *F02N 19/001* (2013.01); *F02N 2200/02* (2013.01); *F02N 2200/06* (2013.01)

(58) Field of Classification Search
USPC ..... 123/179.28, 185.3
See application file for complete search history.

(56) References Cited

U.S. PATENT DOCUMENTS

2018/0347534 A1* 12/2018 Lebreux ..... F02N 11/04
2019/0071161 A1* 3/2019 Noguchi ..... B63H 20/00

OTHER PUBLICATIONS

Oct. 10, 2017, International Search Opinion issued for related PCT Application No. PCT/JP2017/031664.

* cited by examiner

STARTUP ASSISTANCE DEVICE FOR INTERNAL COMBUSTION ENGINE

CROSS REFERENCE TO PRIOR APPLICATION

This application is a National Stage Patent Application of PCT International Patent Application No. PCT/JP2017/031664 (filed on Sep. 1, 2017) under 35 U.S.C. § 371, which is hereby incorporated by reference in its entirety.

TECHNICAL FIELD

The present invention relates to a startup assistance device for an internal combustion engine.

BACKGROUND ART

Patent Literature 1 describes a power tool having an engine, a recoil starter, and an electric motor. In the power tool, when a recoil starter handle is operated by a user and a sensor detects that a recoil rope has been pulled, a controller controls the electric motor to turn a crankshaft. Specifically, in a compression process in which a piston moves toward top dead center, the controller controls the electric motor to rotate the crankshaft. In this case, the rotation speed of the electric motor is controlled so as not to exceed the rotation speed of the recoil rope. That is, the electric motor assists the crankshaft in the rotation, thereby reducing the force to pull the recoil rope by a user.

CITATION LIST

Patent Literature

[Patent Literature 1]: JP-A-2014-66108

SUMMARY OF INVENTION

Technical Problem

Even in the power tool described in Patent Literature 1 described above, when the recoil starter is driven to start up the engine, after a user pulls the recoil rope and stops it in a heavy state, the engine starts up when the recoil rope is further pulled with great force. In the power tool described in Patent Literature 1, when a user pulls the recoil rope, the electric motor makes assistance. However, this is the same as the starting-up method of the related arts in that a user pulls the recoil rope and stops it once in a heavy state before pulling the recoil rope with a large force.

An object of the invention is to provide a startup assistance device for an internal combustion engine which can start up the internal combustion engine which is started up using a recoil starter with a simple operation.

Solution to Problem

The invention provides the following aspects.

According to a first aspect, there is provided a startup assistance device which assists startup of an internal combustion engine (for example, a general-purpose engine E in an embodiment described below) in which fuel is supplied from an electronically controlled fuel injection device (for example, a fuel pump 36, a regulator 32*b*, and an injector 24 in the embodiment described below) and ignition is performed by an ignition device (for example, a spark plug 42 and ignition coil 82 in the embodiment described below), including:

a recoil starter (for example, a recoil starter 74 in the embodiment described below) which is driven by manpower and performs cranking for starting up the internal combustion engine;

an electric rotary machine (for example, a coil 56 and a permanent magnet in the embodiment described below applies torque to a crankshaft of the internal combustion engine during at least one of a startup period of the internal combustion engine using the recoil starter and a standby period before the startup period;

a power source unit (for example, a secondary cell 201, a booster circuit 103, and a converter 70 in the embodiment described below) which supplies power to the electric rotary machine; and a control unit (for example, an ECU 80 in the embodiment described below) which controls the magnitude and time of the torque output by the electric rotary machine.

According to a second aspect, there is provided the startup assistance device for the internal combustion engine according to the first aspect, where the control unit controls the power source unit so that the electric rotary machine outputs top-output torque of the magnitude obtained by subtracting torque obtained by driving the recoil starter from torque required for a piston (for example, a piston 14 in the embodiment described below) of the internal combustion engine to reach top dead center during the standby period.

According to a third aspect, there is provided the startup assistance device for the internal combustion engine according to the second aspect, where the power source unit includes a capacitor (for example, a secondary cell 201 in the embodiment described below) and a converter unit (for example, a converter 70 in the embodiment described below) which converts output voltage of the capacitor into a multi-phase AC voltage, and the control unit stops output of the top-output torque by the electric rotary machine when a temperature of the power source unit exceeds a predetermined value.

According to a fourth aspect, there is provided the startup assistance device for the internal combustion engine according to any one of the first aspect to the third aspect, where the control unit controls the power source unit so that the electric rotary machine outputs a predetermined magnitude of torque for a predetermined time after the recoil starter is driven.

According to a fifth aspect, there is provided the startup assistance device for the internal combustion engine according to the fourth aspect, where the predetermined magnitude of the torque is the same as the top-output torque.

According to a sixth aspect, there is provided the startup assistance device for the internal combustion engine according to the fourth aspect, where the predetermined magnitude of the torque is the maximum torque that the electric rotary machine can output by receiving power from the power source unit.

According to a seventh aspect, there is provided the startup assistance device for the internal combustion engine according to the sixth aspect, where the control unit sets the predetermined magnitude of the torque as the maximum torque when a temperature of the fuel is equal to or lower than a threshold value.

According to an eighth aspect, there is provided the startup assistance device for the internal combustion engine according to the fourth aspect, where the predetermined magnitude of the torque is less than the top-output torque.

According to a ninth aspect, there is provided the startup assistance device for the internal combustion engine according to any one of the fourth aspect to the eighth aspect, where the predetermined time is shorter as the output voltage of the power source unit is lower.

Advantageous Effects of Invention

According to the first aspect, since the torque is applied from the electric rotary machine to the crankshaft of the internal combustion engine from the standby period before starting up the internal combustion engine using the recoil starter, the internal combustion engine starts up when a user simply pulls the recoil starter. In the starting-up method of the related art, a two-step operation is required in which, after the recoil starter is pulled and stopped in a heavy state, the recoil starter is further pulled with a large force. However, according to the first aspect, it is enough to simply pull the recoil starter with a large force, so that the internal combustion engine can be started up with a simple operation.

According to the second aspect, the torque applied to the crankshaft of the internal combustion engine during the standby period before starting up the internal combustion engine has a magnitude obtained by subtracting the torque obtained by driving the recoil starter from the torque required for the piston of the internal combustion engine to reach the top dead center. Therefore, when a user simply pulls the recoil starter, the piston of the internal combustion engine reaches the top dead center and the internal combustion engine starts up. Thus, the internal combustion engine can be started up by a simple operation in which a user simply pulls the recoil starter.

The state in which the electric rotary machine outputs the top-output torque is a state in which the electric rotary machine is not rotating. Therefore, the magnitude of the current flowing through the converter unit of the power source unit is biased in a specific phase. For this reason, among the elements constituting the converter unit, heat generation increases in the element in the phase in which a large current flows, and thus the temperature of the power source unit rises. However, according to the third aspect, when the temperature of the power source unit becomes equal to or greater than the predetermined value, overheating of the power source unit can be prevented by stopping the output of the top-output torque by the electric rotary machine.

According to the fourth aspect, when the recoil starter is driven, the torque output from the electric rotary machine is applied to the crankshaft of the internal combustion engine for the predetermined time. Thus, a user does not need to pull the recoil starter with a large force.

According to the fifth aspect, by making the magnitude of the torque output by the electric rotary machine when the recoil starter is driven and the magnitude of the top-output torque output by the electric rotary machine before the drive the same, the control unit does not need to change the control of the power source unit before and after the recoil starter is driven.

According to the sixth aspect, by setting the torque output from the electric rotary machine when the recoil starter is driven to the maximum torque, the pulling force on the recoil starter by a user can be reduced to the maximum.

In general, when the temperature of the fuel is low, it is difficult to start up the internal combustion engine. However, according to the seventh aspect, the electric rotary machine assists with the maximum torque when the recoil starter is driven, so that the internal combustion engine can be started up easily.

According to the eighth aspect, the power consumption of the power source unit can be reduced by setting the torque output by the electric rotary machine when the recoil starter is driven to less than top-output torque.

According to the ninth aspect, the lower the output voltage of the power source unit, the shorter the time that the electric rotary machine outputs torque when the recoil starter is driven. Thus, the electric rotary machine can assist depending on the state of the power source unit.

DESCRIPTION OF EMBODIMENTS

Hereinafter, an embodiment of the invention will be described with reference to the drawings. The drawings are viewed in the direction of the reference letters.

Figure 1:
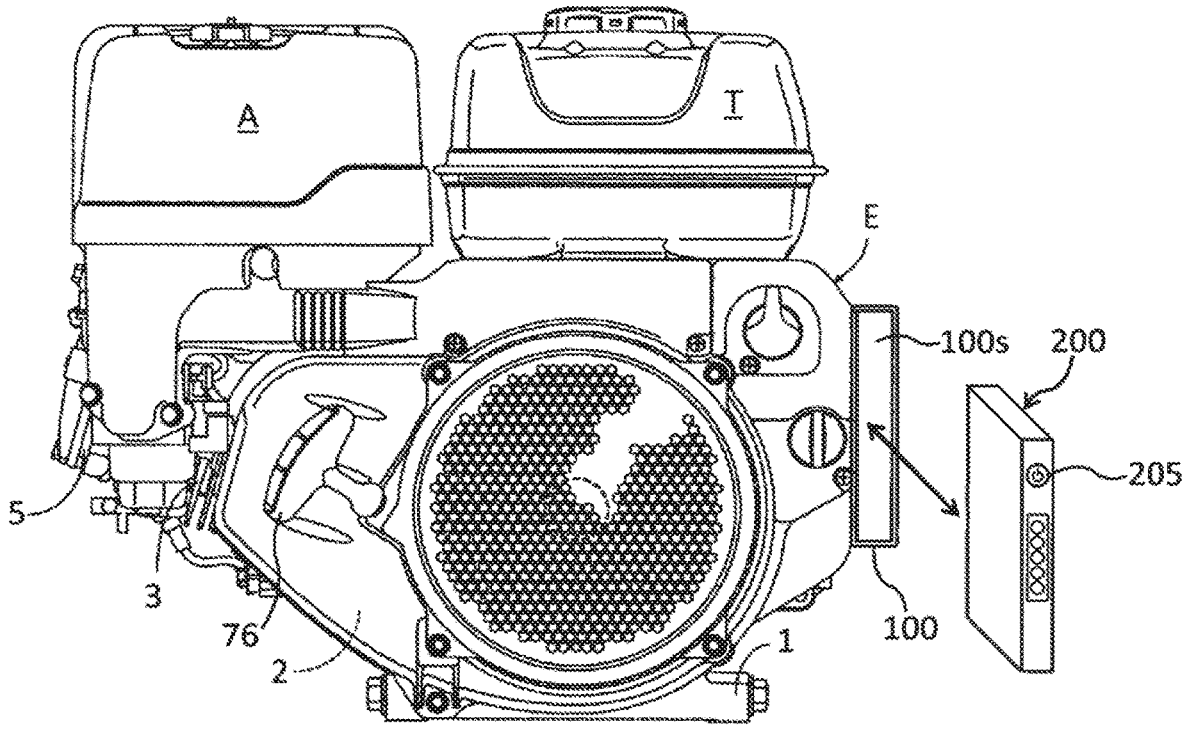
FIG. 1 is a diagram illustrating a relationship among a general-purpose engine, a receptacle, and a power supply device.

FIG. 1 is a diagram illustrating a relationship among a general-purpose engine, a receptacle, and a power supply device. As illustrated in FIG. 1, a power supply device 200 can be attached to and detached from a general-purpose engine E. The general-purpose engine E cannot be started up unless the power supply device 200 is attached to a receptacle 100 provided in the general-purpose engine E. The general-purpose engine E which can be operated by the power supply device 200 is associated with the power supply device 200 in advance. The general-purpose engine E is used as a power source for small industrial working machines for agriculture, construction, or the like.

As illustrated in FIG. 1, the general-purpose engine E includes a crankcase 2 having an installation flange 1 at the bottom, a cylinder block 3 extending obliquely from one side of the crankcase 2, and a cylinder head 5 joined to an end surface of the cylinder block 3 via a gasket. A fuel tank T is attached to the upper part of the crankcase 2 and an air cleaner A is attached to the upper part of the cylinder block 3. The installation flange 1 is installed in a work machine which uses the general-purpose engine E as a power source.

On the other side of the crankcase 2 of the general-purpose engine E, the receptacle 100 for attaching the power supply device 200 to the general-purpose engine E is provided integrally with the general-purpose engine E. A terminal which can be connected to a terminal provided on the back surface of the power supply device 200 is provided in the back of an accommodation space 100*s* of the receptacle 100. When the power supply device 200 is inserted into the accommodation space 100*s* of the receptacle 100 and the terminals are electrically connected to each other, the power supply device 200 becomes ready to start and power is supplied from the power supply device 200 to the general-purpose engine E, and further electrical signals can be transmitted between an Electric Control Unit (ECU) which controls the operation of the general-purpose engine E and a Central Processing Unit (CPU) of the power supply device 200. In this case, when a power switch 205 provided on the front of the power supply device 200 is turned on, the ECU of the general-purpose engine E communicates with the CPU of the power supply device 200, and then the general-purpose engine E becomes ready to start up.

Figure 2:
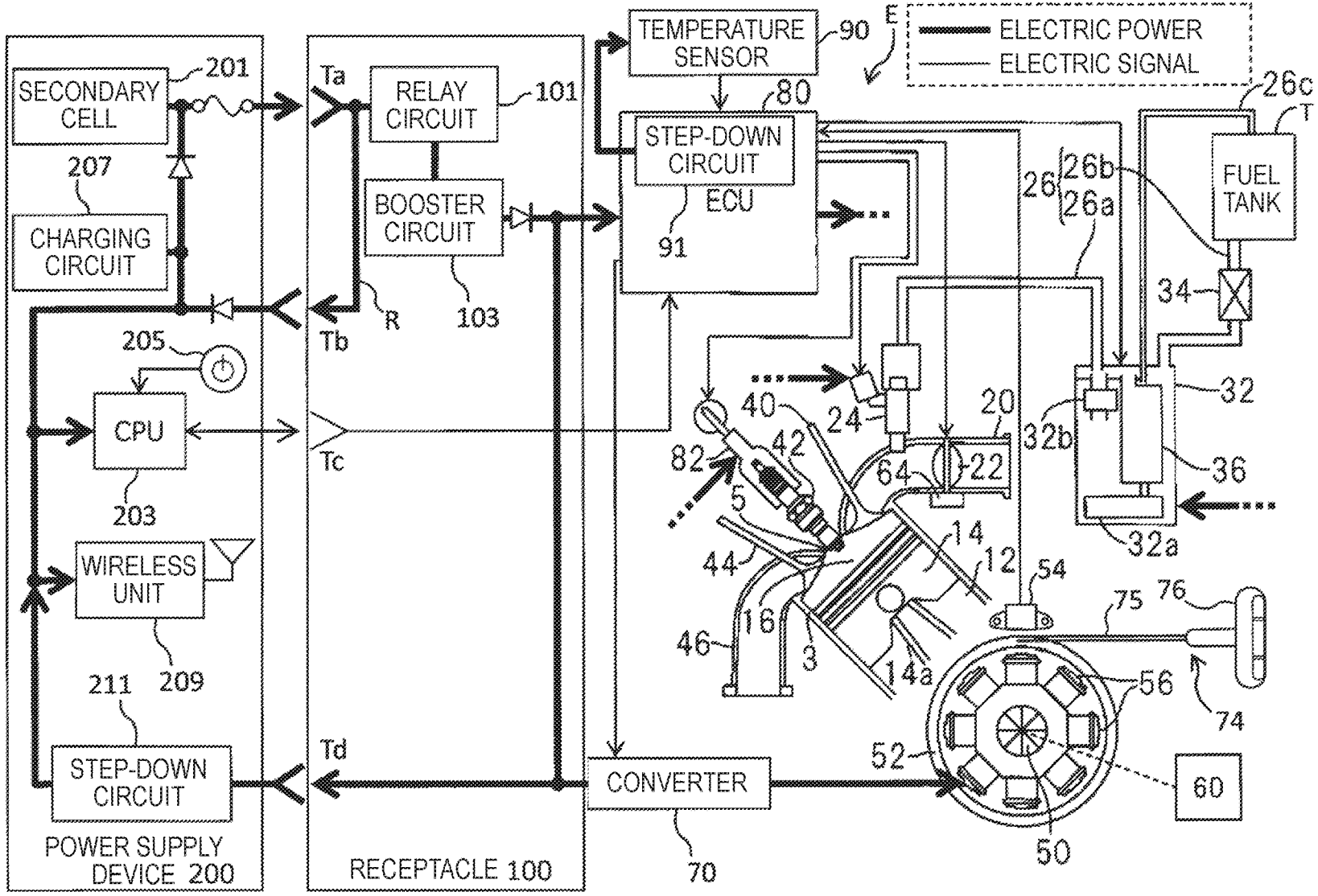
FIG. 2 is a diagram illustrating internal configurations of the general-purpose engine, the receptacle, and the power supply device.

Hereinafter, with reference to FIG. 2, internal configurations of the general-purpose engine E, the receptacle 100, and the power supply device 200, and the relationship between them will be described.

[General-Purpose Engine E]

First, the internal configuration of the general-purpose engine E will be described. In a cylinder 12 formed inside the cylinder block 3 of the general-purpose engine E, a piston 14 is accommodated so as to freely reciprocate. The cylinder head 5 is attached to the cylinder block 3 and a combustion chamber 16 is formed between the top of the piston 14 and the cylinder head 5. An intake pipe 20 is connected to the combustion chamber 16. A throttle valve 22 is disposed in the intake pipe 20 and an injector 24 is disposed in the vicinity of an intake port downstream thereof.

An electric motor (actuator, more specifically, a stepping motor) 64 is connected to the throttle valve 22. The electric motor 64 is configured to open and close the throttle valve 22 independently of the operation of an accelerator lever (not illustrated). That is, the throttle valve 22 is configured as a Drive By Wire type.

The injector 24 is connected to the fuel tank T via a fuel supply pipe 26. More specifically, the injector 24 is connected to a sub-fuel tank 32 via a first fuel supply pipe 26*a* and the sub-fuel tank 32 is connected to the fuel tank T via a second fuel supply pipe 26*b*. A low pressure pump 34 is inserted in the second fuel supply pipe 26*b* and the fuel (gasoline) stored in the fuel tank T is pumped up and pumped to the sub fuel tank 32. A fuel pump (high pressure pump) 36 is disposed in the sub fuel tank 32.

The fuel pump 36 pressurizes the fuel filtered by a filter 32*a* to a high pressure and pumps the fuel to the injector 24 through the first fuel supply pipe 26*a* while adjusting the pressure by a regulator 32*b*. Part of the fuel in the sub-fuel tank 32 is returned to the fuel tank T through a return pipe 26*c*.

The intake air drawn from the air cleaner A flows through the intake pipe 20, reaches the intake port in a state where the flow rate thereof is adjusted by the throttle valve 22, and mixes with the fuel injected from the injector 24 to form an air-fuel mixture. The air-fuel mixture flows into the combustion chamber 16 when an intake valve 40 is opened and burns when a spark plug 42 is ignited by an ignition coil 82 to drive the piston 14. The exhaust gas generated by the combustion flows through an exhaust pipe 46 and is released to the outside when an exhaust valve 44 is opened.

In the cylinder block 3, the crankcase 2 is attached to a side facing the cylinder head 5 and a crankshaft 50 is rotatably accommodated therein. The crankshaft 50 is connected to the piston 14 via a connecting rod 14*a* and rotates according to the driving of the piston 14.

A flywheel 52 is coaxially attached to one end of the crankshaft 50. In addition, one end of a rope 75 of a recoil starter 74 used when starting up the general-purpose engine E is connected to the flywheel 52, and a handle 76 provided at the other end of the rope 75 is provided. When the recoil starter 74 is not used, the rope 75 is wound around a reel (not illustrated). When a user pulls the rope 75 while holding the handle 76 in this state, the crankshaft 50 is rotated together with the flywheel 52 to perform cranking. Thus, the recoil starter 74 is driven by manpower when the internal combustion engine is started up.

A pulsar coil (crank angle sensor) 54 is attached in the crankcase 2 located outside the flywheel 52. By rotating relative to one permanent magnet piece (not illustrated) attached to the surface side of the flywheel 52 and intersecting with the magnetic flux, the pulsar coil 54 produces one output per revolution (per 360 degrees) of the crankshaft 50 at a predetermined crank angle near the top dead center. The output of the pulsar coil 54 is input to the ECU 80 described below.

A plurality of coils 56 are attached to the inside of the crankcase 2 along a circumferential direction with the crankshaft 50 as an axis. In addition, a plurality of permanent magnets (not illustrated) are attached along a circumferential direction about the crankshaft 50 at positions facing the coils 56 on the back side of the flywheel 52. The plurality of permanent magnets and the plurality of coils 56 constitute an AC electric rotary machine. Therefore, when the plurality of permanent magnets and the coils 56 are rotated relative to each other by the rotation of the flywheel 52, the electric rotary machine functions as a generator and an electromotive force is generated in the coil 56. The electromotive force generated in the coil 56 is rectified by the converter 70 and converted into an operating voltage (for example, 12 V) of the ECU 80. On the other hand, when an alternating current is supplied to the coils 56, the electric rotary machine functions as an electric motor and torque is applied to the crankshaft 50 via the flywheel 52. The alternating current supplied to the coil 56 is obtained by the converter 70 converting the direct current supplied from the power supply device 200 via the receptacle 100. The converter 70 includes an element for converting a direct current and an alternating current. When the electric rotary machine operates with a three-phase alternating current, the converter 70 is provided with an element corresponding to each phase current.

The other end of the crankshaft 50 is connected to a working machine 60 which uses the general-purpose engine E as a power source.

Temperature sensors 90 are provided in vicinities of the converter 70 and the fuel tank T. The temperature sensor 90 provided in the vicinity of the converter 70 detects the temperature of the converter 70. The temperature sensor 90 provided in the vicinity of the fuel tank T detects the temperature of the fuel stored in the fuel tank T. A signal indicating the detection value of each temperature sensor 90 is input to the ECU 80. Since the temperature sensor 90 operates at a voltage (for example, 5 V) lower than the operating voltage (for example, 12 V) of the ECU 80, a voltage via the step-down circuit 91 is applied to the temperature sensor 90.

Figure 3:
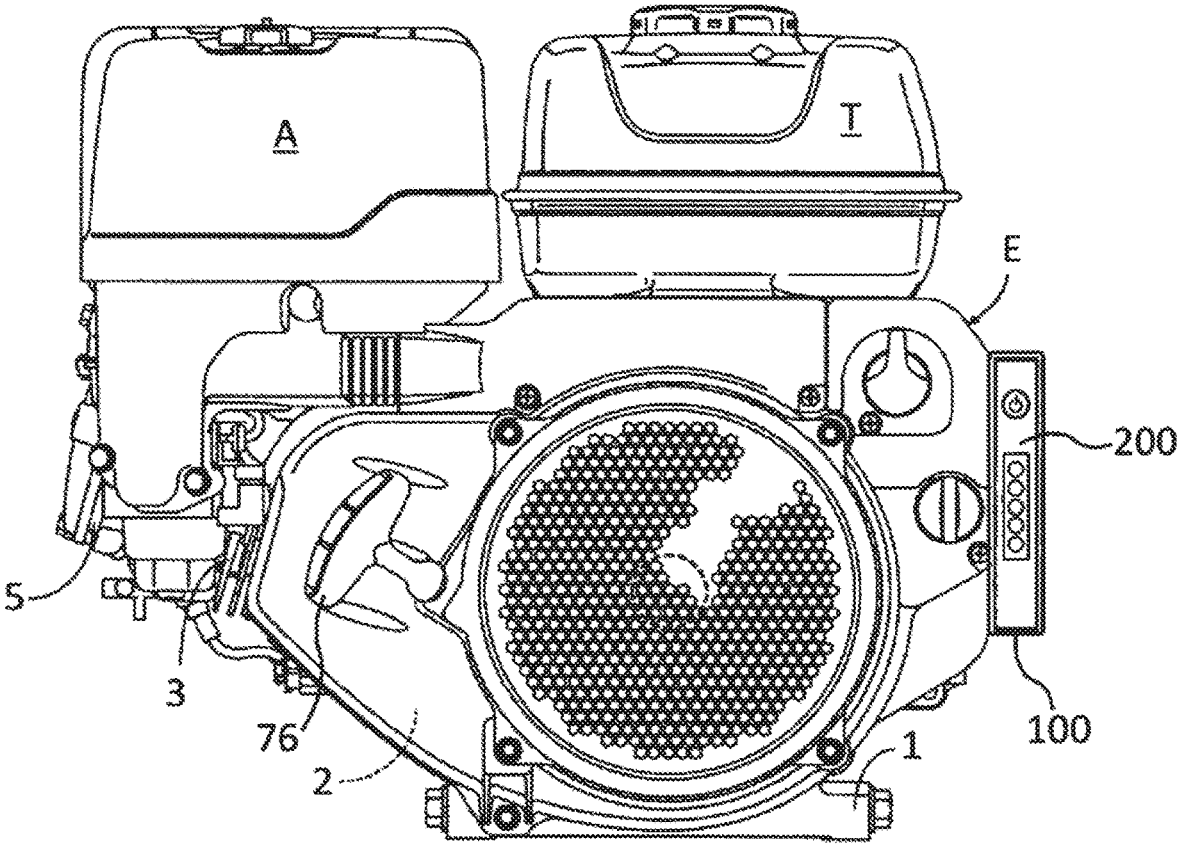
FIG. 3 is a diagram showing a state in which the power supply device is attached to the receptacle provided integrally with the general-purpose engine.

The operations of the fuel pump 36, the regulator 32*b*, the injector 24, the ignition coil 82, the electric motor 64, and the converter 70 described above are controlled by the ECU 80 of the general-purpose engine 10. In addition, the ECU 80 communicates with the CPU 203 of the power supply device 200 via the terminal of the receptacle 100. The power supply to the ECU 80 is performed from the power supply device 200 through the receptacle 100 until the power supply device 200 is attached to the receptacle 100 and the general-purpose engine E starts up and operates stably. Then, when the general-purpose engine E operates stably, the power supply to the ECU 80 is provided by power generation in the electric rotary machine including the coil 56. Similarly, the power supply to the fuel pump 36, the regulator 32*b*, the injector 24, and the spark plug 42 is also performed from the power supply device 200 via the receptacle 100 until the general-purpose engine E operates stably. Then, when the general-purpose engine E operates stably, the power supply is provided by power generation in the electric rotary machine including the coil 56. However, the power supply to the fuel pump 36, the regulator 32*b*, the injector 24, and the spark plug 42 is controlled by the ECU 80. In this way, when the general-purpose engine E is started up, power is supplied from the power supply device 200 to the above-described components which require a power source in a state where the power supply device 200 is attached to the receptacle 100 as illustrated in FIG. 3.

Receptacle 100

Next, the internal configuration of the receptacle 100 provided integrally with the general-purpose engine E will be described. The receptacle 100 includes four terminals Ta to Td, a relay circuit 101, and a booster circuit 103.

The terminal Ta is connected to one end of a switch contact included in the relay circuit 101. When the power supply device 200 is attached to the receptacle 100, the output voltage of the power supply device 200 is applied to the terminal Ta.

The terminal Tb is connected to the terminal Ta through a conduction path R inside the receptacle 100, and when the power supply device 200 is attached to the receptacle 100, the output voltage of the power supply device 200 applied to the terminal Ta is applied to the terminal Tb.

The terminal Tc is connected to the ECU 80 of the general-purpose engine E. When the power supply device 200 is attached to the receptacle 100, the terminal Tc is connected to the CPU 203 of the power supply device 200.

The terminal Td is connected to one end of a converter 70 of the general-purpose engine E. When the power supply device 200 is attached to the receptacle 100, the terminal Td is connected to the input side of a step-down circuit 211 of the power supply device 200.

The relay circuit 101 is a switch having a configuration in which one end of the switch terminal is connected to the terminal Ta and the other end is connected to the input side of the booster circuit 103. The relay circuit 101 is closed if the output voltage of the converter 70 when an electric rotary machine including the coil 56 functions as a generator is equal to or lower than a predetermined value and opens if the voltage exceeds the predetermined value. The predetermined value is a rated output voltage set in the booster circuit 103.

The booster circuit 103 boosts the output voltage of the power supply device 200 applied via the relay circuit 101 at a predetermined boost rate. The output voltage (for example, 12 V) of the booster circuit 103 is applied to the ECU 80.

The output of the booster circuit 103 is connected to one end on the terminal Td side of the converter 70 of the general-purpose engine E in addition to the ECU 80. Therefore, when, after starting up the general-purpose engine E, the general-purpose engine E operates stably, if the voltage obtained by converting the generated voltage of the electric rotary machine including the coil 56 into direct current with the converter 70 is higher than the output voltage of the booster circuit 103, the switch of the relay circuit 101 is opened, so the power supply path from the power supply device 200 to the ECU 80 is opened. In this case, the voltage obtained by converting the generated voltage into direct current with the converter 70 is applied to the ECU 80 of the general-purpose engine E.

Power Supply Device 200

Next, the internal configuration of the power supply device 200 will be described. The power supply device 200 includes a secondary cell 201, the CPU 203, the power switch 205, a charging circuit 207, a wireless unit 209, and the step-down circuit 211.

The secondary cell 201 is a chargeable/dischargeable lithium ion battery which outputs a voltage of about 5 V, for example. The output voltage of the secondary cell 201 is applied to the terminal Ta of the receptacle 100 when the power supply device 200 is attached to the receptacle 100.

The CPU 203 controls the operation of the power supply device 200 including communication with the ECU 80 of the general-purpose engine E, charging operation of the charging circuit 207, operation of the wireless unit 209, and the like. When the power supply device 200 is attached to the receptacle 100, the conduction path R including the terminal Ta and the terminal Tb formed in the receptacle 100 is inserted between the secondary cell 201 and the CPU 203. Therefore, power is supplied from the secondary cell 201 to the CPU 203 via the power supply circuit via the receptacle 100 from the secondary cell 201.

The power switch 205 is operated when the general-purpose engine E is started up or stopped. When the power switch 205 is turned on in a state where the power supply device 200 is attached to the receptacle 100, the CPU 203 communicates with the ECU 80 of the general-purpose engine E. and thus the general-purpose engine E is ready to start up.

The charging circuit 207 charges the secondary cell 201 having a reduced charging rate in a state where the power supply device 200 removed from the receptacle 100 is connected to an external power source via a cable or the like.

For example, the wireless unit 209 performs wireless communication with a portable information terminal owned by a user of the power supply device 200. The power supply from the secondary cell 201 to the wireless unit 209 is performed in a state where the power supply device 200 is attached to the receptacle 100, as similar to the CPU 203.

In a state where the power supply device 200 is attached to the receptacle 100, the step-down circuit 211 steps down the output voltage (for example, 12V), which is applied via the terminal Td of the receptacle 100 and obtained by converting the alternating current into direct current by the converter 70, to 5V, for example. The voltage stepped down by the step-down circuit 211 is applied to the CPU 203 and the wireless unit 209.

Hereinafter, the control of the general-purpose engine E during the start-up and the standby period before the start-up, which is performed in a state where the power supply device 200 is attached to the receptacle 100 of the general-purpose engine E and the power switch 205 of the power supply device 200 is turned on, will be described.

Figure 4A:
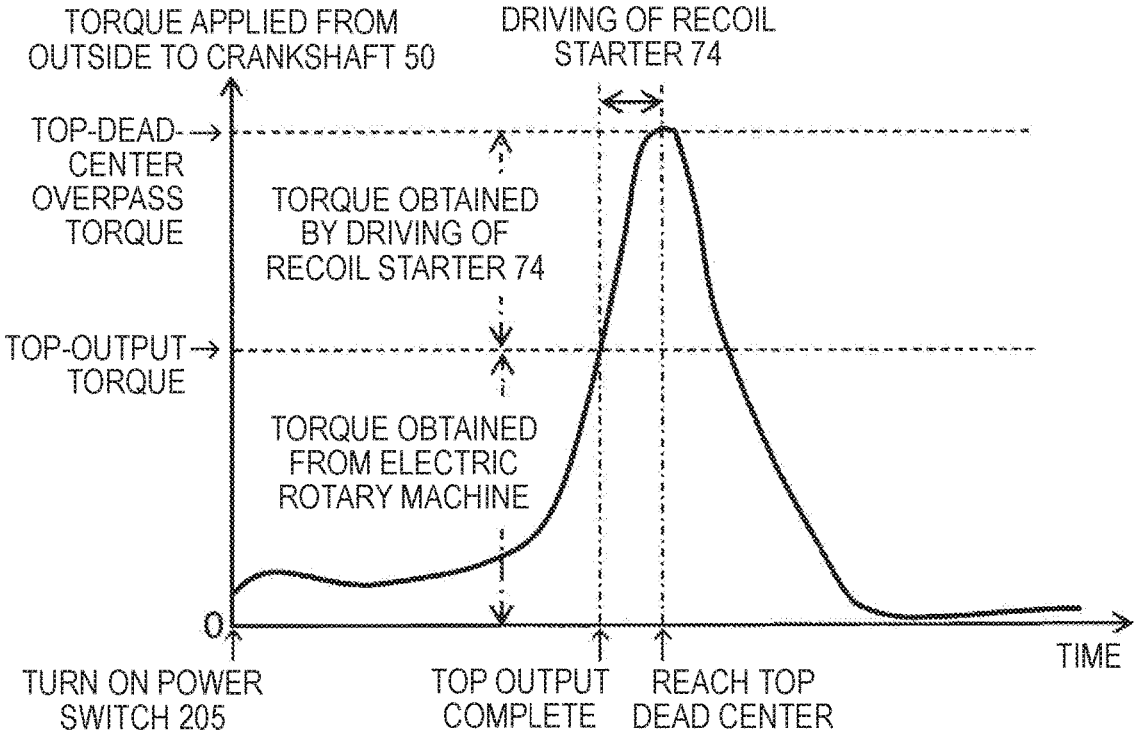
FIGS. 4A and 4B are diagrams illustrating an example of the magnitude of torque applied from the outside to a crankshaft that has changed over time, including the time of startup, from a standby period before the startup of the general-purpose engine.
Figure 4B:
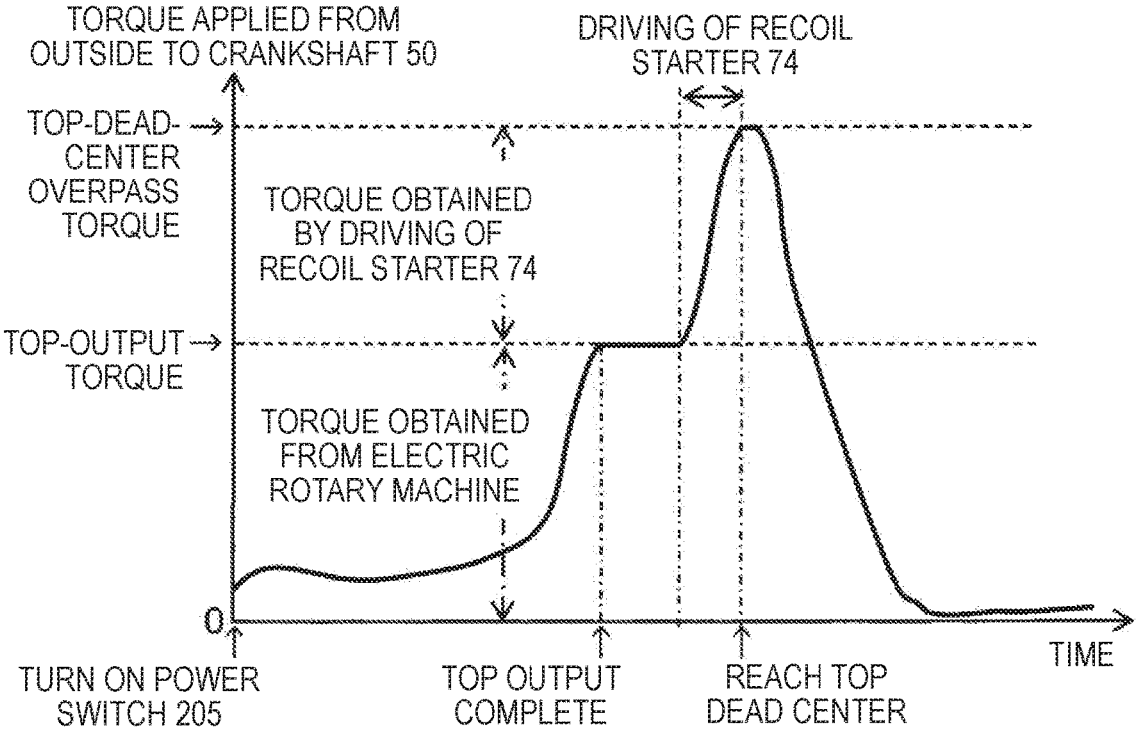

First, the control performed in the standby period before the startup of the general-purpose engine E will be described with reference to FIGS. 4A and 4B. FIG. 4A is a diagram illustrating an example of the magnitude of torque applied from the outside to the crankshaft 50 that has changed over time, including the time of startup, from the standby period before the startup of the general-purpose engine E and FIG. 4B is a diagram illustrating another example. As illustrated in FIGS. 4A and 4B, when the power switch 205 of the power supply device 200 is turned on, the ECU 80 of the general-purpose engine E controls the converter 70 such that the electric rotary machine including the coil 56 outputs the torque (top-output torque) of the magnitude obtained by subtracting the torque obtained by driving the recoil starter 74 from the torque (top-dead-center overpass torque) required for the piston 14 of the general-purpose engine E to reach the top dead center.

Since both the intake valve 40 and the exhaust valve 44 of the general-purpose engine E in the standby period are closed, a large torque (top-dead-center overpass torque) is required for the piston 14 to reach the top dead center. However, in this embodiment, the top-output torque is added in advance to the crankshaft 50 of the general-purpose engine E. Therefore, when a user performs a simple operation by simply pulling the recoil starter 74, the piston 14 reaches the top dead center and cranking is performed. As a result, the general-purpose engine E starts up.

However, during the standby period, when the temperature indicated by the signal obtained from the temperature sensor 90 provided in the vicinity of the converter 70 is equal to or higher than a predetermined value, the ECU 80 stops outputting the top-output torque by the electric rotary machine. The state in which the electric rotary machine including the coil 56 outputs the top-output torque is a state in which the electric rotary machine is not rotating. Therefore, the magnitude of the current flowing through the converter 70 is biased in a specific phase. For this reason, among the elements constituting the converter 70, heat generation increases in the element in the phase in which a large current flows, and thus the temperature of the converter 70 rises. Therefore, when the temperature of the converter 70 becomes equal to or greater than a predetermined value, overheating of the converter 70 can be prevented by stopping the output of the top-output torque by the electric rotary machine.

Figure 5:
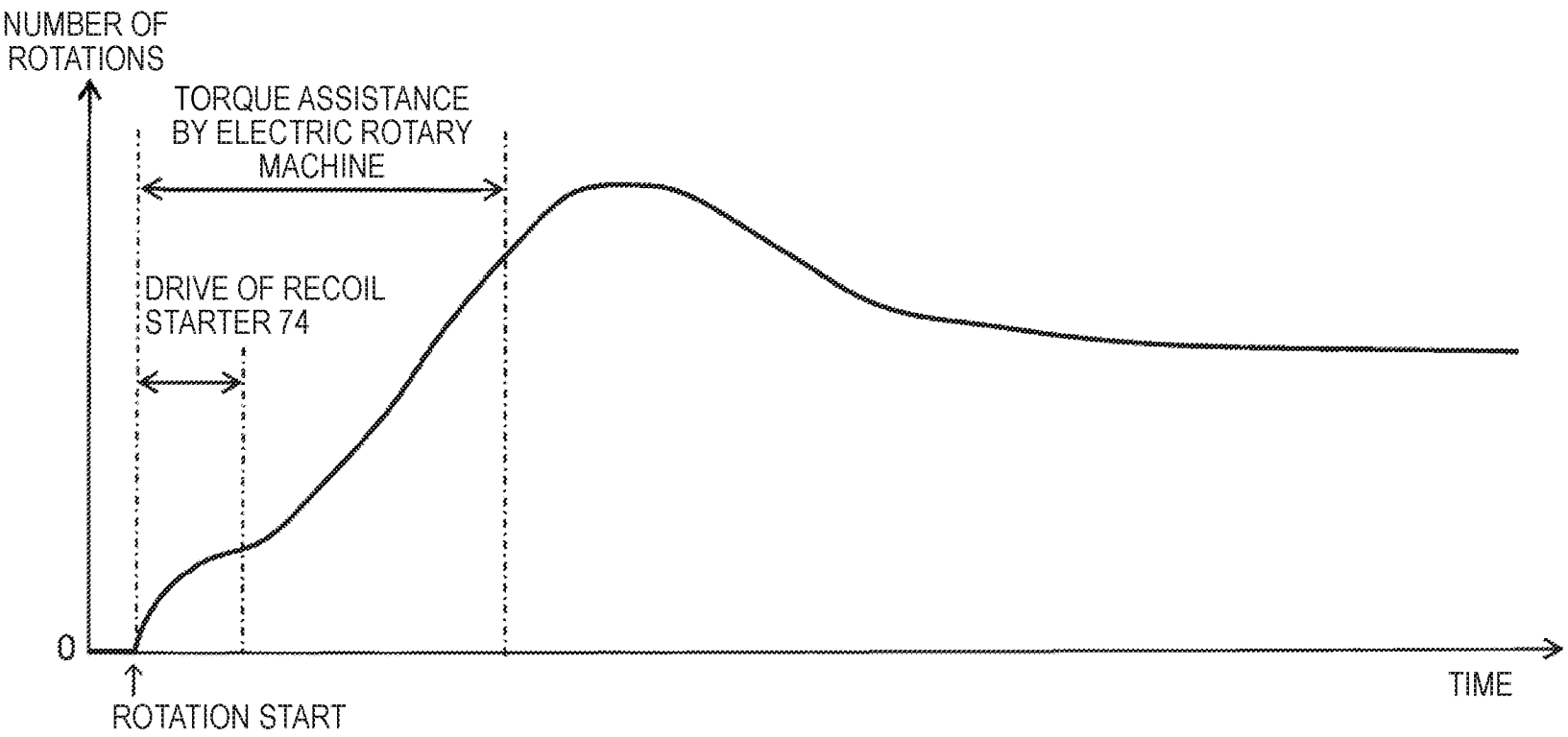
FIG. 5 is a diagram illustrating an example of the number of rotations of the crankshaft that has changed over time, including when the general-purpose engine is started up.

Next, the control performed when starting up the general-purpose engine E will be described with reference to FIG. 5. FIG. 5 is a diagram illustrating an example of the number of rotations of the crankshaft 50 that has changed over time, including when the general-purpose engine F is started up. As illustrated in FIG. 5, when the recoil starter 74 is driven, the ECU 80 of the general-purpose engine E controls the converter 70 so that the electric rotary machine including the coil 56 outputs a predetermined magnitude of torque for a predetermined time from the above driving. Since the torque output from the electric rotary machine is applied to the crankshaft 50 of the general-purpose engine E for the predetermined time from the above driving, a user does not need to pull the recoil starter 74 with a large force.

The magnitude of the torque output by the electric rotary machine when starting up the general-purpose engine E may be the top-output torque output by the electric rotary machine during the standby time, the maximum torque that the electric rotary machine can output according to the voltage output from the converter 70, or a torque less than the top-output torque. When it is equivalent to the top-output torque, it is not necessary to change the control of the converter 70 before and after the recoil starter 74 is driven. When the maximum torque that can be output by the electric rotary machine is set, the force with which a user pulls the recoil starter 74 can be reduced to the maximum. When the torque less than the top-output torque is set, power consumption can be reduced. The magnitude of the torque to be output among those three may be switched according to the mode set in the ECU 80.

Further, when the temperature indicated by the signal obtained from the temperature sensor 90 provided in the vicinity of the fuel tank T is equal to or lower than a threshold value, the maximum torque that can be output by the electric rotary machine may be set. Generally, it is difficult to start up the general-purpose engine E when the temperature of the fuel is low, but if the assist is performed with the maximum torque of the electric rotary machine when the recoil starter 74 is driven, the general-purpose engine E can be easily started up.

Further, the ECU 80 sets a predetermined time during which the electric rotary machine outputs torque when the general-purpose engine E is started up to be shorter as the output voltage of the booster circuit 103 included in the receptacle 100 is lower.

As described above, according to the embodiment, in the standby period before the startup of the general-purpose engine E using the recoil starter 74, the top-output torque is applied from the electric rotary machine including the coil 56 to the crankshaft 50 of the general-purpose engine E. This top-output torque has a magnitude obtained by subtracting the torque obtained by driving the recoil starter 74 from the torque required for the piston 14 of the general-purpose engine E to reach the top dead center. Thus, when a user simply pulls the recoil starter 74, the piston 14 of the general-purpose engine E reaches the top dead center and the general-purpose engine E starts up. In the starting-up method of the related art, a two-step operation is required in which, after the recoil starter 74 is pulled and stopped in a heavy state, the recoil starter 74 is further pulled with a large force. However, in the embodiment, it is enough to simply pull the recoil starter 74 with a large force, so that the general-purpose engine E can be started up with a simple operation.

In addition, the present invention is not limited to the embodiment described above and modifications, improvements, and the likes can be made as appropriate.

REFERENCE SIGNS LIST

E general-purpose engine
1 flange
2 crankcase
3 cylinder block
5 cylinder head
T fuel tank
A air cleaner
12 cylinder
14 piston
14*a* connecting rod
16 combustion chamber
20 intake pipe
22 throttle valve
24 injector
26 fuel supply pipe
26*a* first fuel supply pipe
26*b* second fuel supply pipe
26*c* return pipe
32 sub-fuel tank
32*a* filter
32*b* regulator
34 low pressure pump
36 fuel pump
40 intake valve

42 spark plug
44 exhaust valve
46 exhaust pipe
50 crankshaft
52 flywheel
54 pulsar coil
56 coil
60 working machine
64 electric motor
70 converter
74 recoil starter
75 rope
76 handle
80 ECU
82 ignition coil
100 receptacle
100*s* accommodation space
Ta to Td terminals
101 relay circuit
103 booster circuit
200 power supply device
201 secondary cell
203 CPU
205 power switch
207 charging circuit
209 wireless unit
211 step-down circuit

The invention claimed is:

1. A startup assistance device which assists startup of an internal combustion engine in which fuel is supplied from an electronically controlled fuel injection device and ignition is performed by an ignition device, comprising:

a recoil starter which is driven by manpower and performs cranking for starting up the internal combustion engine;

an electric rotary machine which applies torque to a crankshaft of the internal combustion engine during at least one of a startup period of the internal combustion engine using the recoil starter and a standby period before the startup period;

a power source unit which supplies power to the electric rotary machine; and a control unit which controls the magnitude and time of the torque output by the electric rotary machine, wherein the control unit sets a predetermined magnitude of the torque as a maximum torque when a temperature of stored fuel is equal to or lower than a threshold value.

2. The startup assistance device for the internal combustion engine according to claim 1, wherein the control unit controls the power source unit so that the electric rotary machine outputs top-output torque of the magnitude obtained by subtracting torque obtained by driving the recoil starter from torque required fora piston of the internal combustion engine to reach top dead center during the standby period.

3. The startup assistance device for the internal combustion engine according to claim 2, wherein the power source unit includes a capacitor and a converter unit which converts output voltage of the capacitor into a multi-phase AC voltage, and the control unit stops output of the top-output torque by the electric rotary machine when a temperature of the power source unit exceeds a predetermined value.

4. The startup assistance device for the internal combustion engine according to claim 1, wherein the control unit controls the power source unit so that the electric rotary machine outputs the predetermined magnitude of torque for a predetermined time after the recoil starter is driven.

5. The startup assistance device for the internal combustion engine according to claim 4, wherein the predetermined magnitude of the torque is the same as the top-output torque.

6. The startup assistance device for the internal combustion engine according to claim 4, wherein the predetermined magnitude of the torque is the maximum torque that the electric rotary machine can output by receiving power from the power source unit.

7. The startup assistance device for the internal combustion engine according to claim 4, wherein the predetermined magnitude of the torque is less than the top-output torque.

8. The startup assistance device for the internal combustion engine according to claim 4, wherein the predetermined time is shorter as the output voltage of the power source unit is lower.

9. The startup assistance device for the internal combustion engine according to claim 1, wherein the internal combustion engine includes a fuel tank in which the stored fuel is contained and a temperature sensor which is provided in vicinity of the fuel tank and configured to detect the temperature of the stored fuel.

10. The startup assistance device for the internal combustion engine according to claim 1, wherein the maximum torque is of a magnitude that is the highest the electric rotary machine can output.

11. The startup assistance device for the internal combustion engine according to claim 1, wherein the magnitude of the torque output by the electric rotary machine is controlled by the control unit so as to provide a maximum assistance when the recoil starter is driven during a low temperature fuel condition.

* * * * *